US007481252B2

(12) United States Patent
Koyanagi

(10) Patent No.: US 7,481,252 B2
(45) Date of Patent: Jan. 27, 2009

(54) STRUCTURE OF CHECK VALVE FOR AIR-PACKING DEVICE

(75) Inventor: Hidetoshi Koyanagi, Kashiwara (JP)

(73) Assignee: Air-Paq, Inc., Lake Forest, CA (US)

( * ) Notice: Subject to any disclaimer, the term of this patent is extended or adjusted under 35 U.S.C. 154(b) by 531 days.

(21) Appl. No.: 11/351,470

(22) Filed: Feb. 10, 2006

(65) Prior Publication Data

US 2007/0186993 A1 Aug. 16, 2007

(51) Int. Cl.
*B65B 3/16* (2006.01)

(52) U.S. Cl. ..... 141/114; 141/32; 141/35; 141/68; 141/166; 141/325

(58) Field of Classification Search ..... 141/114, 141/1.1, 32, 35, 68, 166, 240, 325, 326; 206/522; 383/3, 44, 48, 53; 137/846, 843, 844
See application file for complete search history.

(56) References Cited

U.S. PATENT DOCUMENTS 5,469,966 A 11/1995 Boyer
6,067,778 A 5/2000 Yamamoto et al.
7,249,612 B2 * 7/2007 Koyanagi ..... 383/44

* cited by examiner

*Primary Examiner*—Khoa D Huynh
(74) *Attorney, Agent, or Firm*—Finnegan, Henderdon, Faraow, Garrett & Dunner, LLP

(57) ABSTRACT

A check valve for an air-packing device comprises upper and lower check valve films that are placed between upper and lower packing films that form the air-packing device contour. The check valve can be advantageously used for the air-packing device having a multiplicity of air containers. A common air duct that allows compressed air to flow into each air container through the check valve is formed between the upper and lower check valve films independently from other films such that the check valve can be placed flexibly in the air-packing device. Peeling agents are applied between the upper and lower check valve films to create the common air duct by preventing heat-sealing between the films.

18 Claims, 18 Drawing Sheets

STRUCTURE OF CHECK VALVE FOR AIR-PACKING DEVICE

FIELD OF THE INVENTION

This invention relates to an air-packing device for use as packing material, and more particularly, to a structure of check valve incorporated in the air-packing device for achieving an improved shock absorbing capability to protect a product from shock or impact where the check valve has a simple structure and can be established in a small size with high reliability.

BACKGROUND OF THE INVENTION

There are several choices in the packing and shipping industries for shock absorbing material for protecting products from damages due to shocks and vibrations during the distribution channels of the products. One of those choices has been styrofoam. Although using styrofoam as packaging material has benefits such as good thermal insulation and light weight, it also has various disadvantage. For example, recycling styrofoam is not possible, soot is produced when it burns, a flake or chip comes off when it is snagged because of its brittleness, and expensive mold is needed for its production, and a relatively large warehouse is necessary for storage.

Therefore, to solve such problems noted above, other packing materials and methods have been proposed. One method is a fluid container that seals in liquid or gas such as air (hereinafter "air-packing device"). Such an air-packing device has excellent characteristics that solve the problems involved with styrofoam. First, because the air-packing device is made only of thin plastic films, it does not need a large warehouse for storage until immediately prior to product packing when the air-packing device is inflated. Second, a large mold is not necessary for its production because of its simple structure. Third, the air-packing device does not produce a chip or dust which may have adverse effects on precision products. Furthermore, recyclable materials can be used for the films forming the air-packing device. Additionally, the air-packing device can be produced and stored with low cost and transported with low cost.

An example of a structure of such an air-packing device is shown in FIG. 1. The air-packing device 20 includes a plurality of air containers 22 and check valves 24, a guide passage 21, and an air input 25. The air from the air input 25 is supplied to the air containers 22 through the air passage 21 and the check valves 24. The air-packing device 20 is composed of two thermoplastic films that are bonded together at bonding areas 23*a*. Each air container 22 is provided with a check valve 24.

One of the purposes of having multiple air containers with corresponding check valves is to increase the reliability of the air-packing device. Because each air container 22 is independent from the others, even if one of the air containers suffer from an air leakage for some reason, the remaining air containers 22 that are still intact and remain inflated. Therefore, the air-packing device can still function as a shock absorber.

FIG. 2 is a plan view of the air-packing device 20 of FIG. 1 when it is not inflated showing bonding areas for closing two thermoplastic films. The thermoplastic films of the air-packing device 20 are bonded (heat-sealed) together at bonding areas 23*a* which are rectangular periphery thereof to air-tightly close the air-packing device. The thermoplastic films of the air-packing device 20 are also bonded together at bonding areas 23*b* each forming the boundary between two adjacent air containers 22 to air-tightly separate the air containers 22 from one another.

When using the air-packing device, each air container 22 is filled with air from the inlet port 25 through the guide passage 21 and the check valve 24. After filling the air-packing device with the air, the expansion of each air container 22 is maintained because each check-valve 24 prevents the reverse flow of the air. The check valve 24 is typically made of two small thermoplastic valve films that are bonded together to form an air pipe. The air pipe has a tip opening and a valve body to allow the air flowing in the forward direction through the air pipe from the tip opening but the valve body disallows the air to flow in the backward direction.

As noted above, the structure of the air-packing device having a multiplicity of air-containers, each of which having a check valve that prevents reverse flow of compressed air, is advantageous in improving reliability of the air-packing device. In order to allow various shapes (contour) of air-packing devices to accommodate various shapes and sizes of products to be protected, it is desirable that the check valve can be manufactured with ease and allows flexibility of designing the air-packing device.

SUMMARY OF THE INVENTION

It is, therefore, an object of the present invention to provide a structure of check valve for use with an air-packing device which has a simple structure with low cost and can be established in a small size so that each air cell of the air-packing device can be significantly decreased.

It is another object of the present invention to provide a structure of check valve for use with an air-packing device which can be established at any location of the air-packing device with high reliability.

It is a further object of the present invention to provide a structure of check valve and air-packing device which is able to reduce the size of each air cell on the air-packing device.

One aspect of the present invention is a structure of check valve for an air-packing device. The structure of check valves includes a plurality of air containers each being made of upper and lower packing films by applying separation seals where a check valve is provided to each air container; upper and lower check valve films for forming a plurality of check valves where peeling agents of predetermined pattern are applied between the upper and lower check valve films, the upper and lower check valve films being attached to one of the upper and lower packing films; an air input established by one of the peeling agents on the air-packing device for receiving an air from an air source; an air passage formed in each check valve by heat-seals between the upper and lower check valve films, the air passage including a narrow channel formed by the separation seal and one of the heat-seals between the upper and lower check valve films; and a common air duct formed between the upper and lower check valve films for providing the air from the air input commonly to the plurality of check valves. The heat-sealing between the upper and lower check valve films is prevented in a range where the peeling agent is applied, thereby creating the common air duct.

The upper and lower packing films are separate thermoplastic films, and wherein the upper and lower check valve films are separate thermoplastic films which are provided between the upper and lower packing films. Alternatively, the upper and lower packing films are separate thermoplastic films, and the upper and lower check valve films are configured by a single sheet of thermoplastic film which is folded into two and is provided between the upper and lower packing films.

The upper and lower check valve films are attached to one of the upper and lower packing films at any desired locations of the air-packing device. The air passage in the check valve is closed by air tightly contacting the upper check valve film and the lower check valve film by the air pressure within the air container when the air-packing device is filled with the compressed air to a sufficient degree.

The peeling agent between the upper and lower check valve films is located on a part of the separation seal, and wherein the air input is an opening between the upper check valve film and the lower check valve film created by a pattern of the peeling agent. The pattern of the peeling agent applied to the check valve films is a belt like shape extending on the separation seal of the air-packing device.

Another aspect of the present invention is an air-packing device incorporating the structure of check valve. The air-packing device includes a plurality of air containers each being made of upper and lower packing films by applying a pair of separation seals where a check valve is formed for each air container; a plurality of air cells formed in a series manner in each container by partially bonding the upper packing film and the lower packing film by applying folding seals; upper and lower check valve films for forming a plurality of check valves where peeling agents of predetermined pattern are applied between the upper and lower check valve films, the upper and lower check valve films being attached to one of the upper and lower packing films; an air input established by one of the peeling agents on the air-packing device for receiving an air from an air source; an air passage formed in each check valve by heat-seals between the upper and lower check valve films, the air passage including a narrow channel formed by the separation seal and one of the heat-seals between the upper and lower check valve films; and a common air duct formed between the upper and lower check valve films for providing the air from the air input commonly to the plurality of check valves. The heat-sealing between the upper and lower check valve films is prevented in a range where the peeling agent is applied, thereby creating the common air duct.

According to the present invention, the structure of check valve for an air-packing device is simple and allows reduction of the size of each check valve such that more freedom is attained in designing the air packing device. Moreover, the check valves under the present invention can be flexibly attached to any desired location of the air-packing device due to the common duct that is formed between the upper and lower check valve films independently from the packing films.

DETAILED DESCRIPTION OF THE INVENTION

The new structure of check valve for use with an air-packing device under the present invention is described in detail with reference to the accompanying drawings. The construction of check valve under the present invention allows to significantly reduce the size of the check valve itself such that more freedom is attained in designing the air packing device. Accordingly, it is also possible to reduce the size of each air cell so that the air-packing device of the present invention can replace the conventional air bubble packing sheets. Moreover, the check valve under the present invention can be flexibly attached to the air-packing device at any location.

Figure 1:
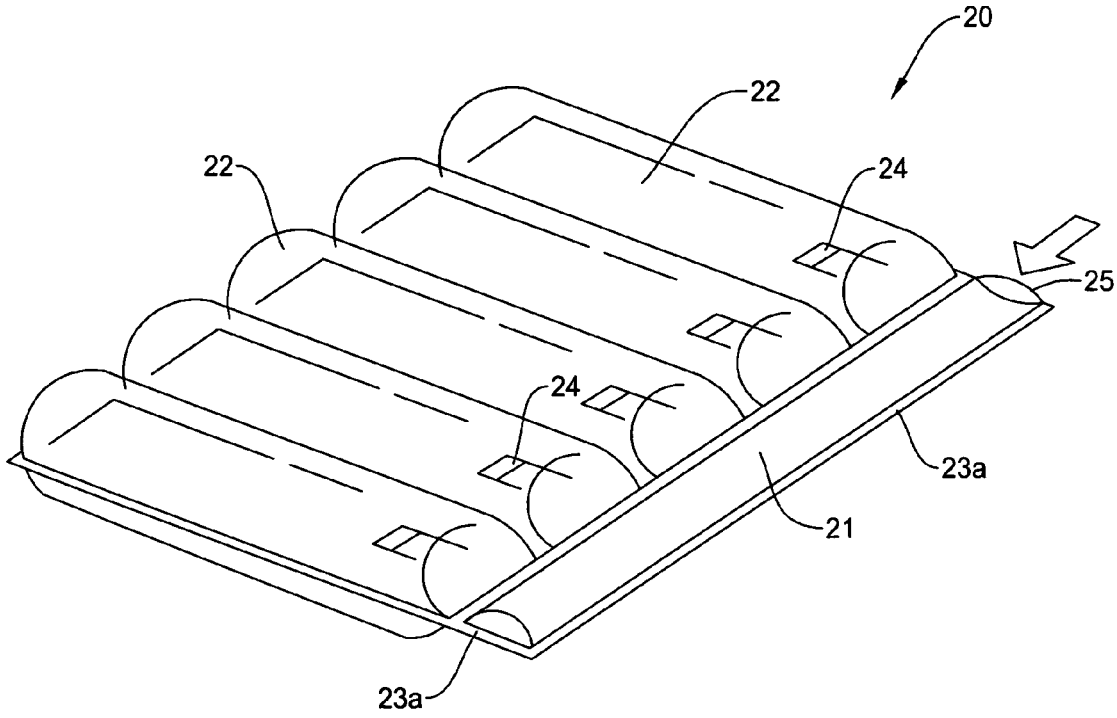
FIG. 1 is a perspective view showing an example of basic structure of an air-packing device in the conventional technology.
Figure 2:
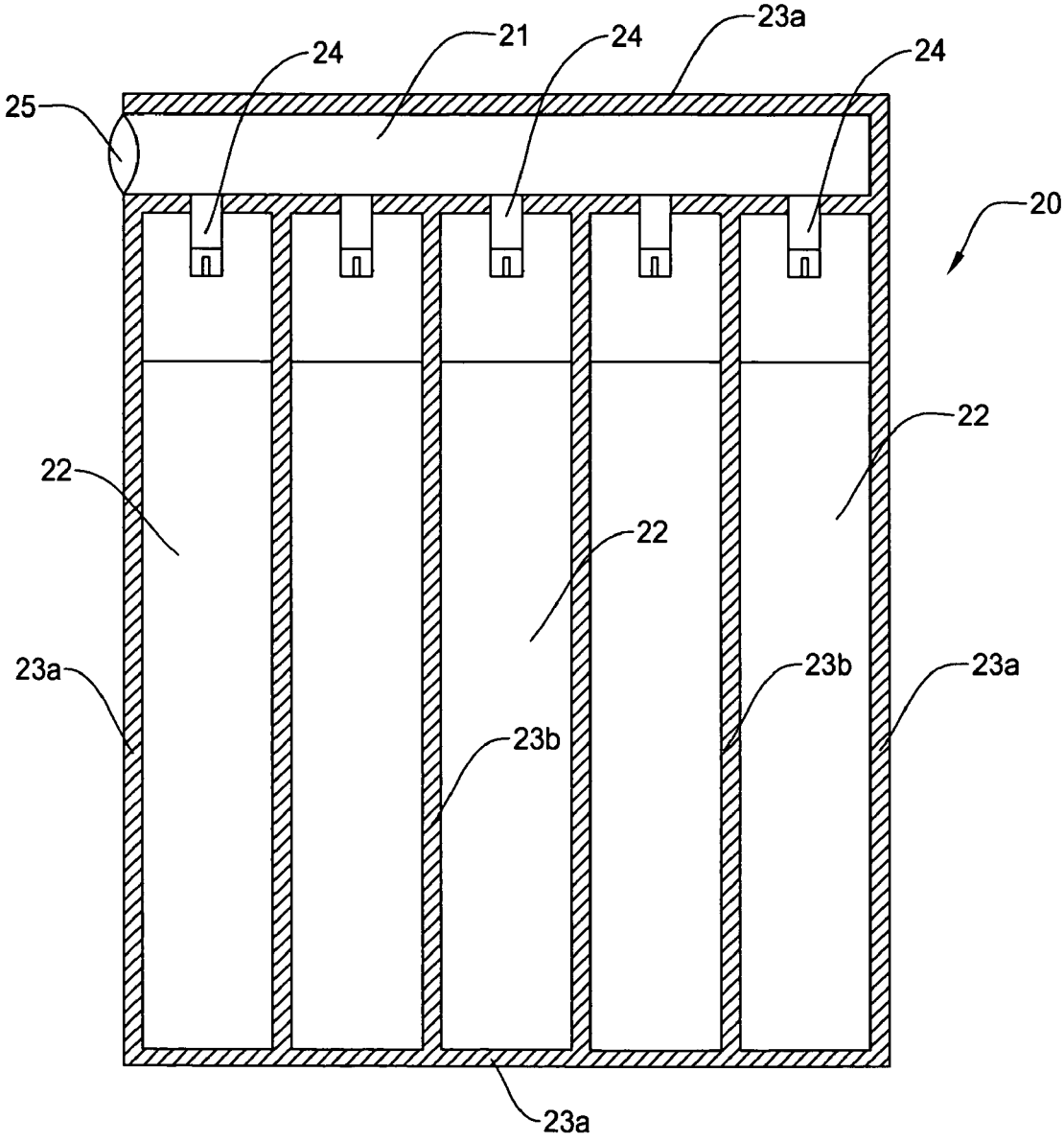
FIG. 2 is a plan view of the air-packing device of FIG. 1 when it is not inflated for showing bonding areas for closing two thermoplastic films.
Figure 3:
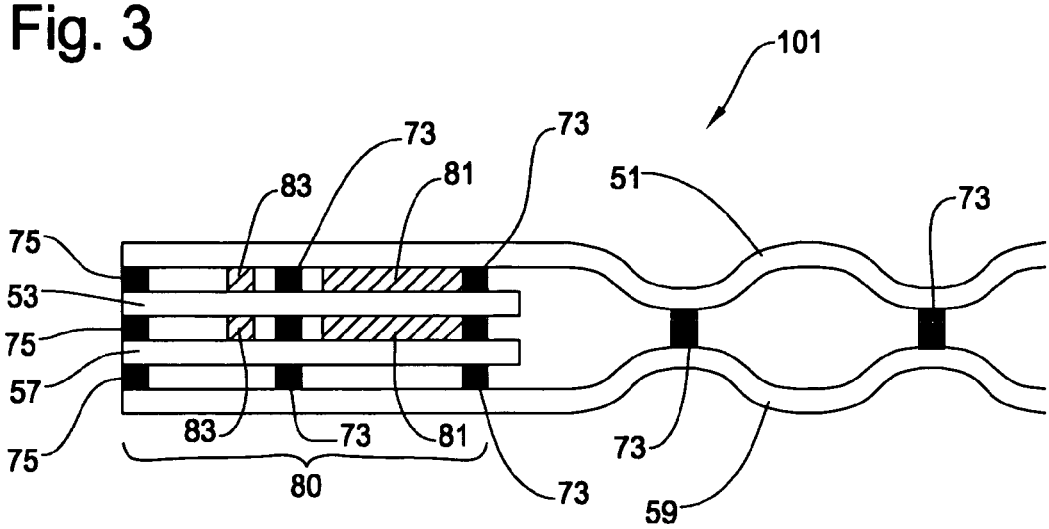
FIG. 3 is a schematic cross sectional view showing an example of structure of the air-packing device and check valve under the present invention.

The basic configuration of the check valve for an air-packing device under the present invention is described with reference to the schematic cross sectional view of FIG. 3 and the plan views of FIGS. 4A and 4B. FIG. 3 schematically shows a cross-sectional front view of four sheets of thermoplastic films that comprise the air-packing device and the check valve of the present invention. The cross sectional of FIG. 3 depicts the condition as viewed from the arrow A in the plan view of FIG. 4A. As shown, four thermoplastic films 51, 53, 57 and 59 are overlapped with one another in a predetermined order and position.

The upper packing film 51 and the lower packing film 59 function are thermoplastic films which create the main body of the air-packing device 101 with a plurality of air containers. The upper check valve film 53 and the lower check valve film 55 are small thermoplastic films for creating a plurality of check valves 80 with a common air duct 92 that commonly introduces the air to each air container 70 through each check valve. The common duct 92 and the air containers 70 will be explained later with reference to FIGS. 4A and 4B.

Figure 4A:
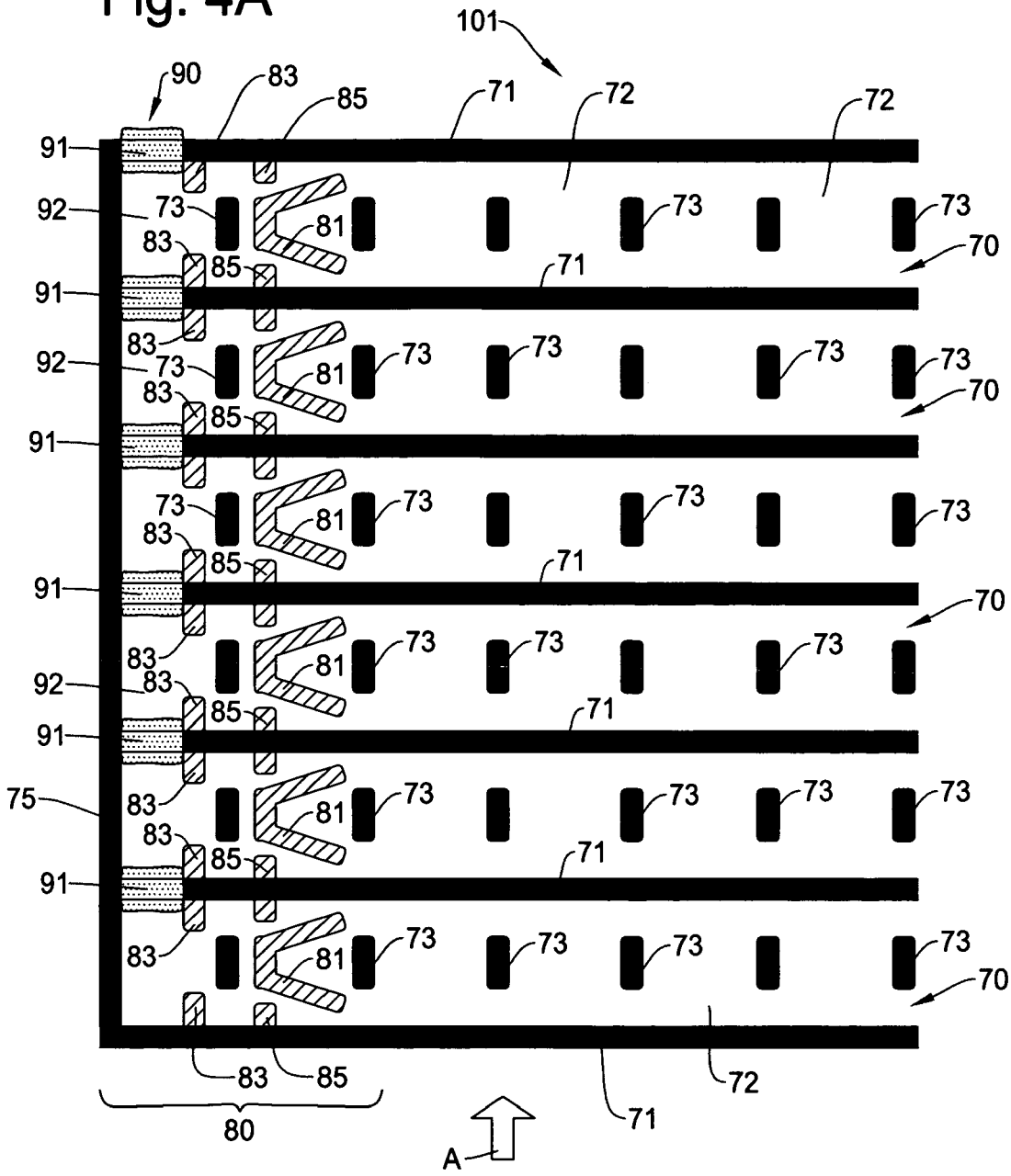
FIGS. 4A and 4B are plan views showing the air-packing device and the check valve under the present invention where sealed areas are hatched in FIG. 4A to indicate the sealing among the thermoplastic films while in FIG. 4B, the sealed areas are not hatched to show functional components of the air-packing device.
Figure 4B:
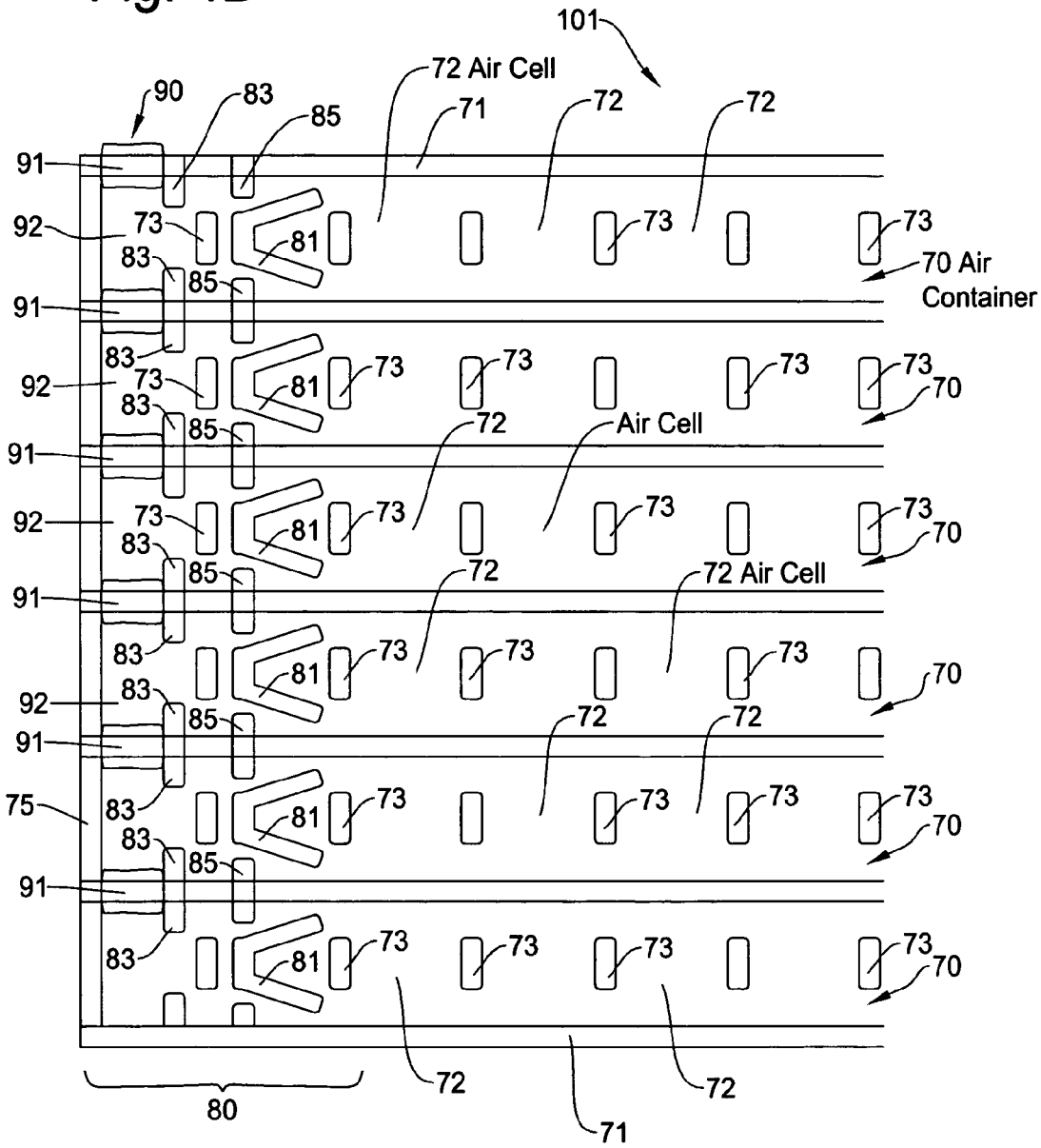

In FIGS. 3 and 4A, the areas where thermoplastic films are bonded (heat-sealed) are indicated by diagonal line hatches and solid hatches. Basically, the areas of solid hatch indicate that the upper and lower packing films 51 and 59 and the check valve films 53 and 57 are heat-sealed with one another. The areas of diagonal line hatch indicate that the check valve films 53, 57 and the upper packing film 51 (but not lower packing film 59) are heat-sealed with one another. It should be noted that the thickness of the thermoplastic films, and shapes and sizes of the bonded areas are exaggerated in FIGS. 3 and 4A to clearly illustrate the structure of the check valve 80.

In FIGS. 3 and 4A, such heat-sealed (bonded) areas include separation seals 71 which create a plurality of air containers 70, folding seals 73 which partially separate each air container 70 to create a plurality of air cells 72 connected in series, an edge seal 75 for air-tightly closing the edge of the air-packing device 101, obstruction seals 83 and 85 for producing resistance against the flow of the air in the check valve 80, and air guide seals 81 for guiding the forward flow of the air through a narrow air passage created with the separation seal 71 when the compressed air is supplied to the air-packing device 101.

As explained with reference to the side view of FIG. 3, the air-packing device 101 incorporating the check valve 80 of the present invention is comprised of four thermoplastic films 51, 53, 57 and 59. Accordingly, the plan view of FIGS. 4A and 4B show the air-packing device 101 where the four thermoplastic films are overlapped as shown in FIG. 3. The check valve 80 and the air-packing device 101 in FIG. 4 is in the condition where the compressed air is not supplied to the air-packing device 101 and, thus, it is not inflated.

All of the thermoplastic films are bonded to one another at the separation seals 71. In other words, when the four thermoplastic films 51, 53, 57 and 59 are overlaid, all four thermoplastic films are bonded to one another at the solid hatches. When the two thermoplastic films 51 and 59 are overlaid, the two thermoplastic films are bonded with each other at the solid hatches. By the separation seals, the air-packing device 101 is separated to a plurality of air containers 70.

The upper packing film 51 and the lower packing film 59 are further bonded to one another at the folding seals 73 indicated by the solid hatches. In the area where the check valve films 53 and 57 are inserted to form the check valves 80, all of the four thermoplastic films are bonded to one another at the separation seals 73 indicated by the solid hatches. Further, all of the thermoplastic films are bonded to one another at the edge seals 75 indicated by the solid hatches if the check valves 80 are located at the edge of the air-packing device. If the check valves 80 are formed at a position other than the edge of the air-packing device, i.e., an inner area of the packing device, the upper packing film 51 and the lower packing film 59 are bonded to one another at the edge 75 of the air-packing device 101.

The diagonal line hatches shown in FIG. 4A indicate the air guide seals 81, and the obstruction seals 83 and 85 where the upper packing films 51, upper check valve film 53, and lower check valve film 55 are bonded with one another. In other words, the check valve films 53 and 55 are not bonded to the lower packing film 59. This means that there is created an air passage between the lower check valve film 57 and the lower packing film 59.

In FIG. 4A, the areas indicated by dot hatches are provided with peeling agents 91 between the upper check valve film 53 and the lower check valve film 55. The peeling agent 91 is a high heat-resistance material which prevents the heat-sealing (bonding) between the thermoplastic films. Each peeling agent 91 has a pattern which is larger than the width of the separation seal 71. The pattern of the peeling agent 91 in this example is a belt like shape. In other words, at the area where the peeling agent 91 is applied, the thermoplastic films are not bonded through the heat-sealing process.

As shown in FIG. 3, the upper check valve film 53 and the lower check valve film 57 are sandwiched between the upper packing film 51 and the lower packing film 59. Thus, the upper check valve film 53 and the lower check valve film 57 are not bonded at the dot hatch areas because of the peeling agents 91. Further, because of the peeling agents 91, the separation seals 71 between the upper packing film 51 and the lower packing film 59 are also interrupted, thereby creating a common air duct 92 through the plurality of dot hatched areas (peeling agents 91). Thus, when the air is supplied to an air input 90 (peeling agent 91 forming the air input) at the upper left of FIG. 4A, the air can be supplied to all of the check valves 80 and to the air containers 70 through the common air duct 92.

Because of the structure of the heat-seals among the packing films and check valve films described above, the air packing device 101 in this embodiment allows the air to flow in the forward direction. Reference is now made to FIG. 4B, which is a simplified plan view showing the check valves 80 in the air-packing device 101 under the present invention to explain structural components. FIG. 4B is similar to FIG. 4A, except that the bonded areas are not hatched and functional components of the air-packing device 101 are indicated. As shown in FIG. 4B, the common air duct 92 is created at the left side of the check valves 80 due to the peeling agents 91. Two adjacent separation seals 71 create a strip of air container 70 which is further divided by the folding seals 73 into a plurality of air cells 72.

Figure 5:
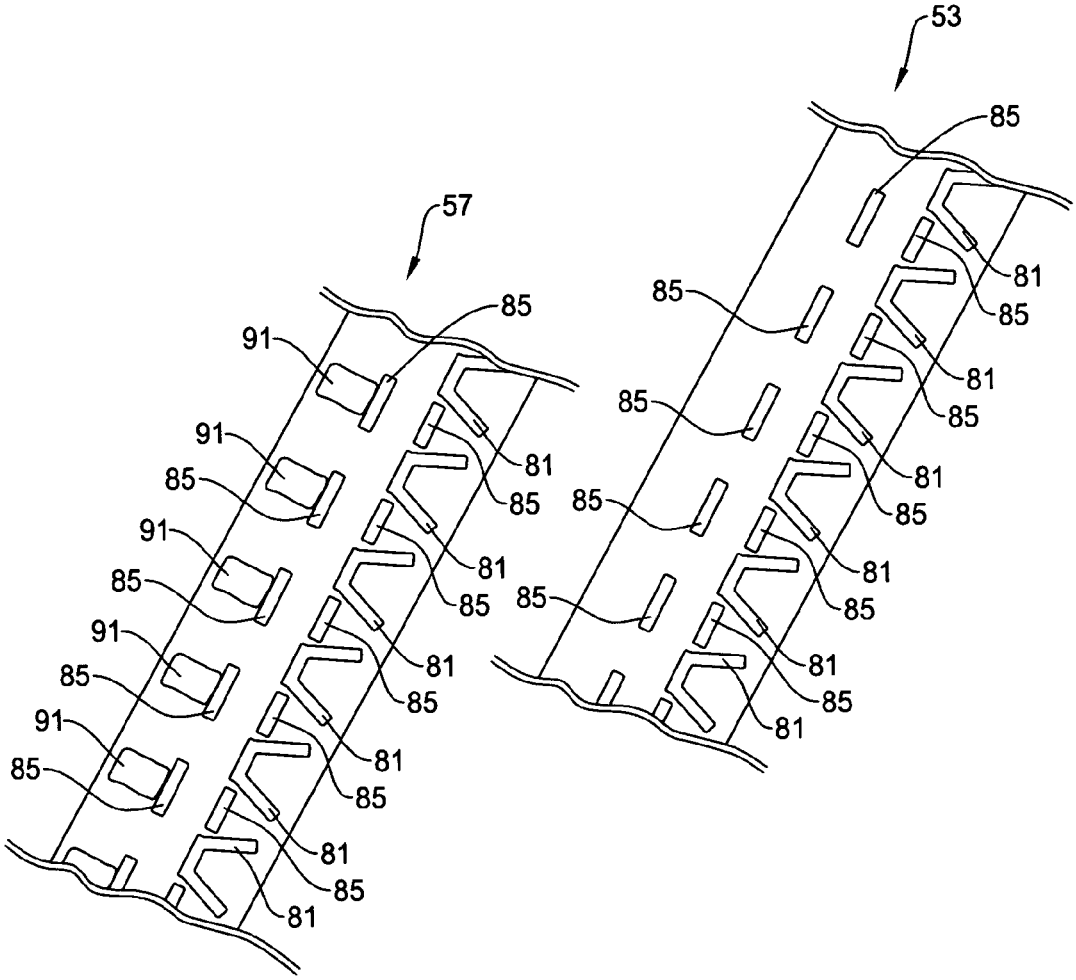
FIG. 5 is a plan view showing an upper check valve film and a lower check valve film to indicate the relationship between the peeling agent and the heat-seals in the present invention.

FIG. 5 is a schematic view showing the relationship between the upper check valve film 53 and the lower check valve film 57 under the present invention. The upper check valve film 53 and the lower check valve film 57 are mostly identical to each other. However, the peeling agent 91 is applied to the upper surface of the lower valve film 57, i.e., between the upper check valve film 53 and the lower check valve film 57. As seen from FIGS. 4A and 4B, the peeling agents 91 are located at the input areas (left edge of the air-packing device 101) of the check valves 80 at the ends of the separation seals 71.

As noted above, the peeling agent 91 is a high heat-resistant material which prevents the heat-sealing between the two thermoplastic films. Thus, in the present invention, the peeling agent 91 prevents the lower check valve film 57 and the upper check valve film 53 from bonding with each other when the heat-sealing process is applied to the air-packing device 101. For this purpose, it is also possible to apply the peeling agent 91 on the lower surface of the upper check valve film 53.

The separation seals 71 for separating the air containers 70 by heat-sealing the thermoplastic films (upper and lower packing films) 51 and 59 are not effective at the locations of the peeling agents 91. Thus, the two air containers 70 are not separated by the separation seals 71 where the peeling agents 91 are applied. As noted above, the upper check valve film 53 and the lower check valve film 57 are not bonded because of the peeling agents 91. Therefore, the common duct 92 is formed that allows the air from the air input 90 to flow into all of the check valves 80 and the air containers 70.

The obstruction seals 83 and 85, and the air guide seal 81 are shown on the upper check valve film 53 and the lower check valve film 57 in FIG. 5. However, the obstruction seals 83 and 85, and the air guide seal 81 in FIG. 5 are illustrated only to indicate their shapes and positions in relation to the peeling agents 91. In practice, the obstruction seals 83 and 85, and the air guide seal 81 will be created after the packing film 51 and the check valve films 53 and 57 are overlapped and a heat-sealing process is applied to the these three thermoplastic films.

Figure 6:
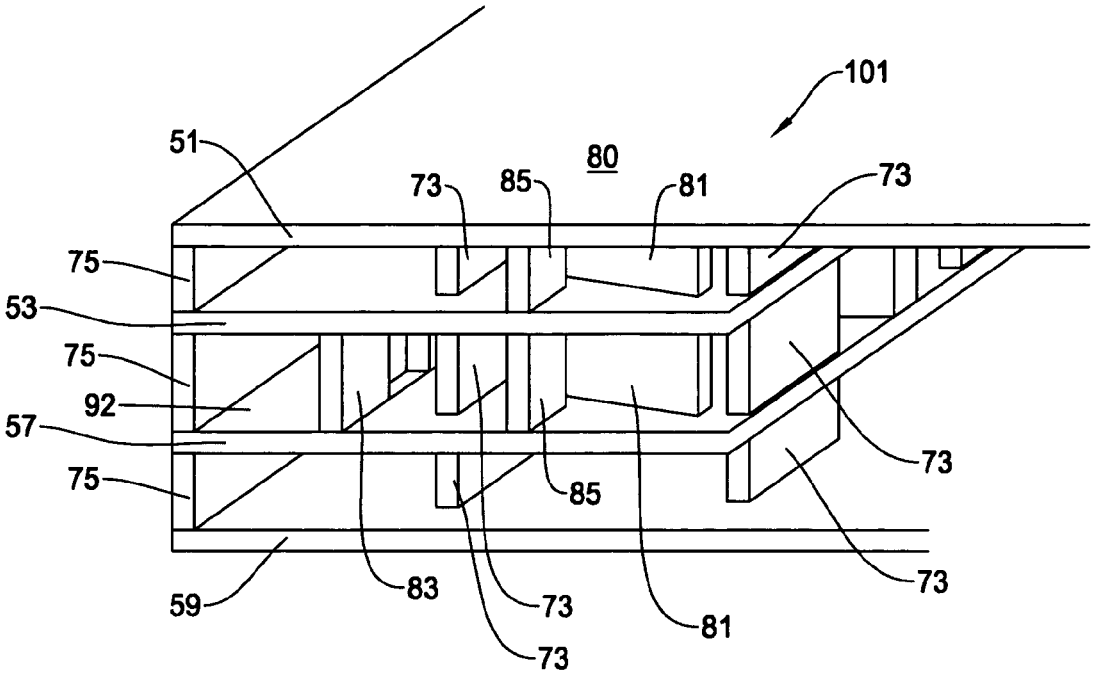
FIG. 6 is an enlarged perspective view of the upper packing film, the lower packing film, the upper check valve film, and the lower check valve film to show the inner structure of an embodiment of the air-packing device of the present invention.

FIG. 6 is a schematic cross-sectional perspective view showing the check valve 80 formed in the air packing device 101 under the present invention. This configuration depicts the embodiment shown in FIGS. 3, 4A-4B, and 5 in a perspective view to help facilitate understanding of the structure of the check valve 80 and the air packing device 101 in the present invention. As described above, the air-packing device 101 incorporating the check valve 80 of the present invention is composed of the upper packing film 51, the lower packing film 59, the upper check valve film 53 and the lower check valve film 55. The common air duct 92 is formed by the obstruction seal 83, the edge seal 75, and the upper check valve film 53 and the lower check valve film 57 where the peeling agent 91 is not shown.

The compressed air from air input flows through the common air duct 92 and flows into each air container 70 through the check valve 80. The folding seals 73 bond all of the films 51, 53, 57 and 59 in the check valve 80. The folding seals 73 where the check valve films 53 and 57 are not provided bond the upper and lower packing films 51 and 59 as shown in FIG. 3. The obstruction seals 83, 85 and the air guide seals 81 create air passages in the check valve 80 between the upper valve film 53 and the lower valve film 57 for the compressed air from the air input to flow under certain resistance.

It should be noted that the structure shown in FIG. 6 is exaggerated to show the structural feature of the check valve. Although the perspective view of FIG. 6 depicts the check valve with the thick thermoplastic films and the heat-seals, actual thermoplastic films and seals are much thinner. In an actual implementation, as noted above, the air guide seals 81, the obstruction seal 83, the edge seal 75, folding seals 73 are created by heat-sealing the thermoplastic films. Thus, in reality, the seals do not have such a thickness as depicted in FIG. 6 but are flatly bonded by two or more thermoplastic films.

Figure 7:
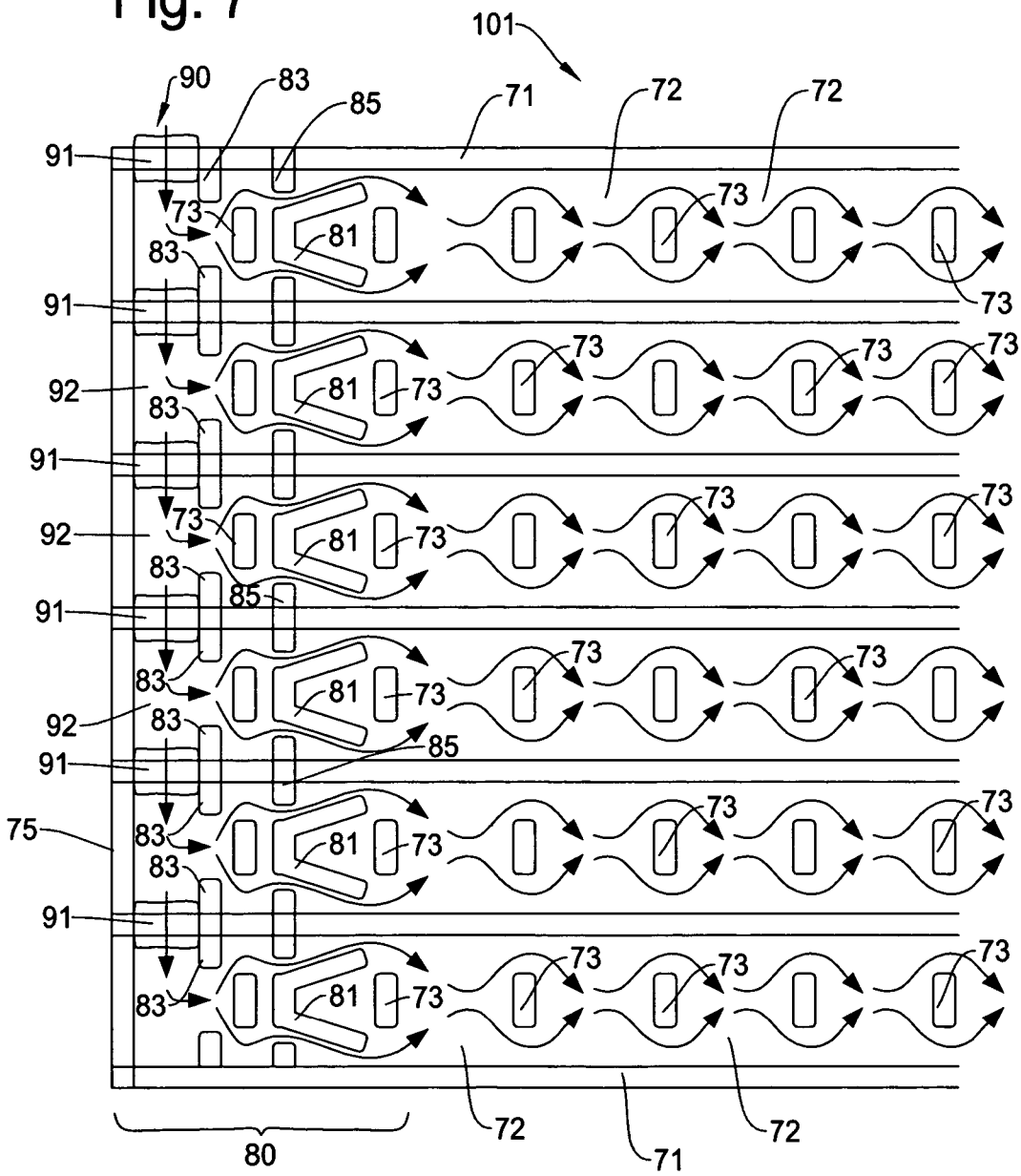
FIG. 7 is a plan view showing the air-packing device having the check valve under the present invention illustrating arrows that indicate the flow of the compressed air when the compressed air is supplied to the air input to inflate the air-packing device.

Now, the explanation is made as to how the air flows in the structure of the air-packing device 101 having the check valve 80 under the present invention and how the check valve 80 function to prevent a reverse flow of the air. FIG. 7 is a top view similar to FIG. 4B showing the check valve 80 and the air-packing device 101 including the arrows indicating the manner of the air flow. The compressed air is introduced into the air input 90 (peeling agent 91 at the upper left) of the air-packing device 101.

As shown, the air from the air input 90 flows to each air container 70 (air cells 72) via the common air duct 92 formed by the upper check valve film 53 and the lower check valve film 57 as explained above. The obstruction seals 83, folding seals 73, the air guide seal 81, and the obstruction seals 85 create complicated air passages or air flow mazes to establish a certain degree of resistance against the forward flow the air. The air flow mazes are also function to completely close the check valve 80 when the inner pressure of the air-packing device reaches a predetermined level. The air introduced to the first air container 70 (within the check valve 80) through the pair of obstruction seals 83 collides against the folding seal 73 and diverts into the sides as indicated by the arrows.

The compressed air then enters the narrow air passages each being formed between the air guide seal 81 and the obstruction seals 85. Further, each of the air passages for the compressed air is gradually narrowed due to the diagonal shape of the air guide seal 81 with respect to the separation seal 71. Particularly, a small distance between the end of the air guide seal 81 and the separation seal 71 establishes a narrow air passage. These air passages will be completely closed when the check valve films 53 and 57 are pressed against the upper packing film 51 by the inner pressure produced by the compressed air.

After the compressed air leaves the check valve 80, the air will fill the air container 70, thereby inflating each of the air container 70. Since the folding seals 73 are provided in this embodiment, each air container 70 includes a plurality of air cells 72. Thus, each air cell will be shaped like a sausage when the air container 70 is inflated by the compressed air. Since the thermoplastic films are bonded at the areas of the folding seals 73, the inflated air-packing device 101 can be easily folded about the holding seals 73.

As the compressed air fills the air container 70, the air will press the check valve films 53 and 57 against the upper packing film 51 so that three thermoplastic films are tightly contact with one another. Thus, the air passages in the check valves 80 are completely closed, which prevents reverse flow of the air. The detail of this procedure and operation is more clearly described with reference to FIGS. 8A and 8B. The cross sectional views of FIGS. 8A and 8B show the operation of the check valve 80 in the air-packing device 101 when the compressed air is supplied to the air input 90.

Figure 8A:
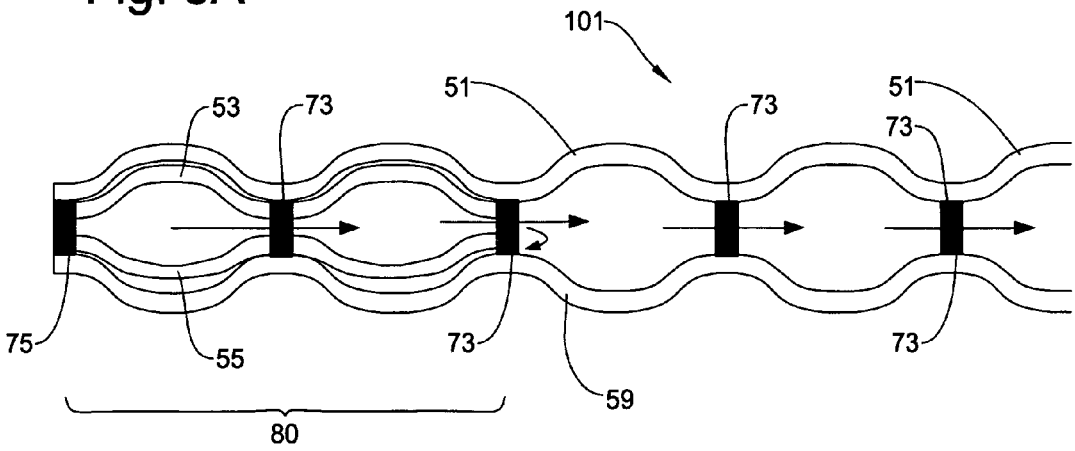
FIGS. 8A and 8B are cross sectional views of the air-packing device having the check valve under the present invention illustrating arrows that indicate the flow of the compressed air when the compressed air is supplied to the air input to inflate the air-packing device.

FIG. 8A shows an early stage for inflating the air-packing device 101 where the compressed air is not sufficiently filled in the air-packing device 101. The compressed air indicated by the arrows is introduced by, for example, an air compressor (not shown) from the air input 90 to each air container through the common duct 92. During this stage, the compressed air is introduced in the manner described above with reference to FIG. 7. Since the check valve films 53 and 57 are not bonded to the lower packing film 59, the compressed air also flows into the space between the lower check valve film 57 and the lower packing film 59 as shown by the curved arrow.

Figure 8B:
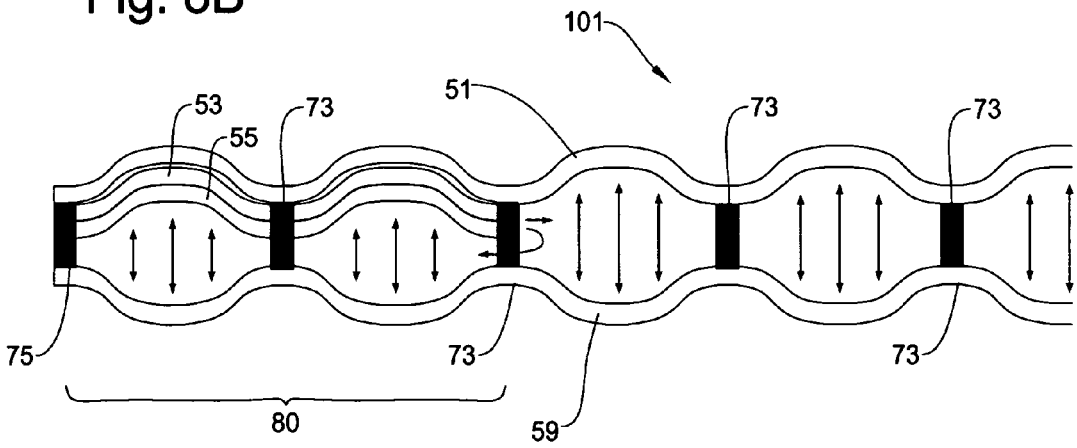

FIG. 8B shows the condition where the compressed air is sufficiently filled in the air-packing device 101. As noted above, since the compressed air is also filled in the space between the lower check valve film 57 and the lower packing film 59, the check valve films 53 and 57 are pressed upwardly. Thus, the upper packing film 51, the upper check valve film 53 and the lower check valve film 57 are tightly contact with one another. As a result, the narrow air passages formed by various seals noted above are completely closed by the air pressure, thereby preventing the reverse flow of the air in the check valves 80.

Figure 9:
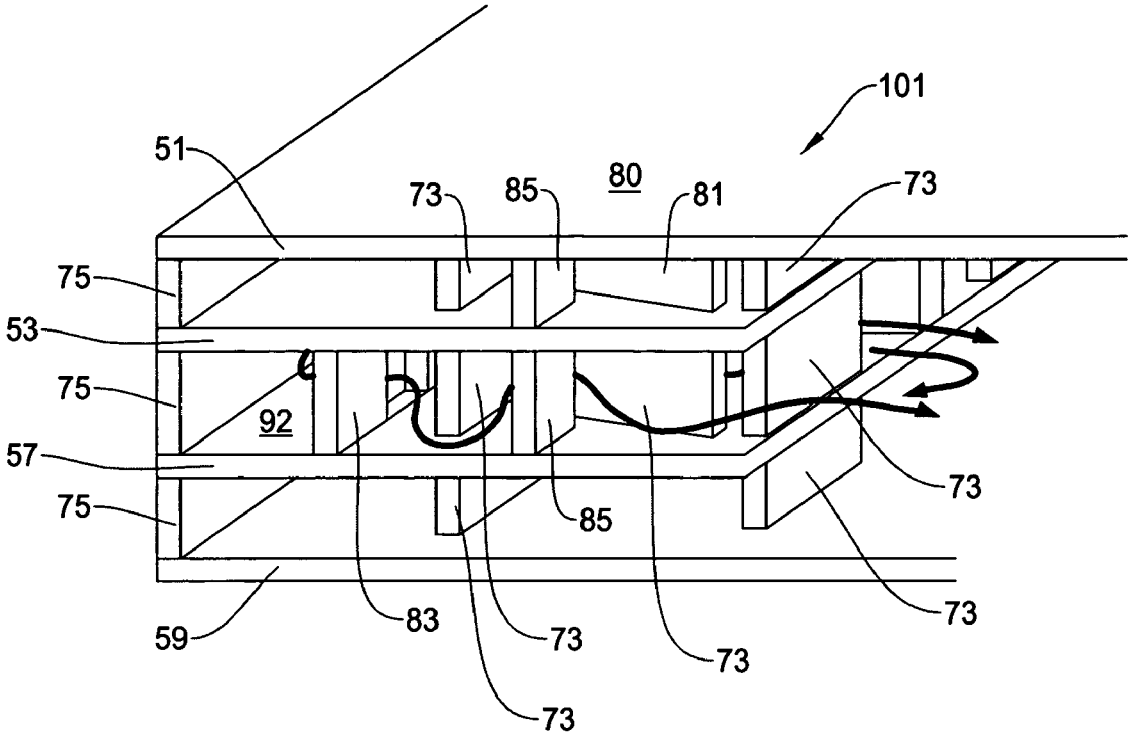
FIG. 9 is an enlarged perspective view of the upper packing film, the lower packing film, the upper check valve film, and the lower check valve film in the embodiment of the air-packing device under the present invention where the arrows indicate the flow of the compressed air when the compressed air is supplied to the air input to inflate the air-packing device.

FIG. 9 is a cross-sectional perspective view showing the check valve 80 of the air packing device 101 under the present invention similar to the one shown in FIG. 6. FIG. 9 includes the arrows that indicate the flow of the compressed air introduced through the common air duct 92 into each container 70. As the arrows indicate, the air that flows through the common duct 92 will enter the opening formed by the pair of obstruction seals 83.

The compressed air then travels through the air passages (air flow maze) formed by the folding seal 73, obstruction seals 85 and the air guide seal 81. The compressed air travels toward the exit opening (narrow channel) of the check valve 80 formed between the tip of the air guide seal 81 and separation seal 71 (FIGS. 4A and 4B) so that the air fills each air container 70. The compressed air also flows under the lower check valve film 57 as indicated by downwardly curved arrow. Thus, the compressed air upwardly presses the check valve films 53 and 57 to close the air passages by air tightly contacting the upper packing film 51 and the check valve films 53 and 57 with one another (FIG. 8B).

Figure 10A:
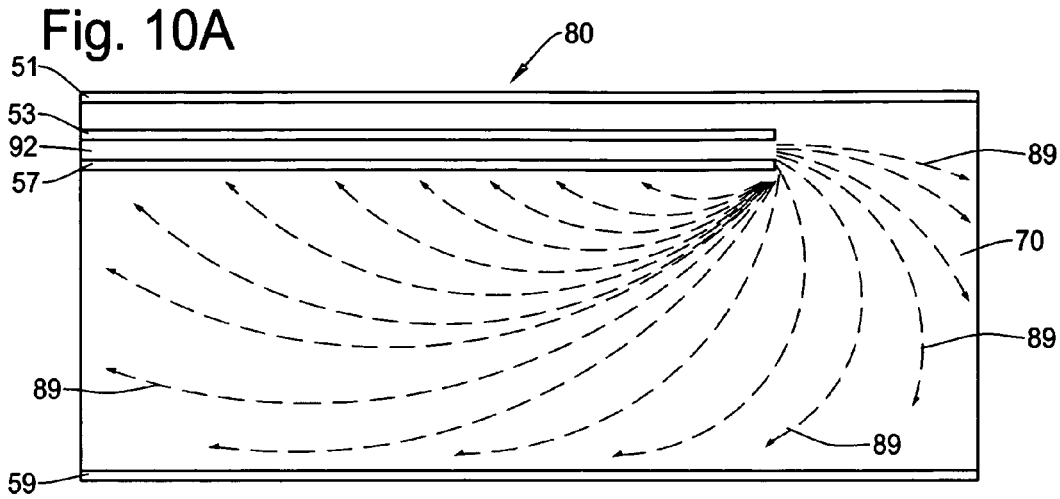
FIGS. 10A and 10B are simplified cross-sectional views of the check valve and the air packing device under the present invention to illustrate the basic operation of the check valve.
Figure 10B:
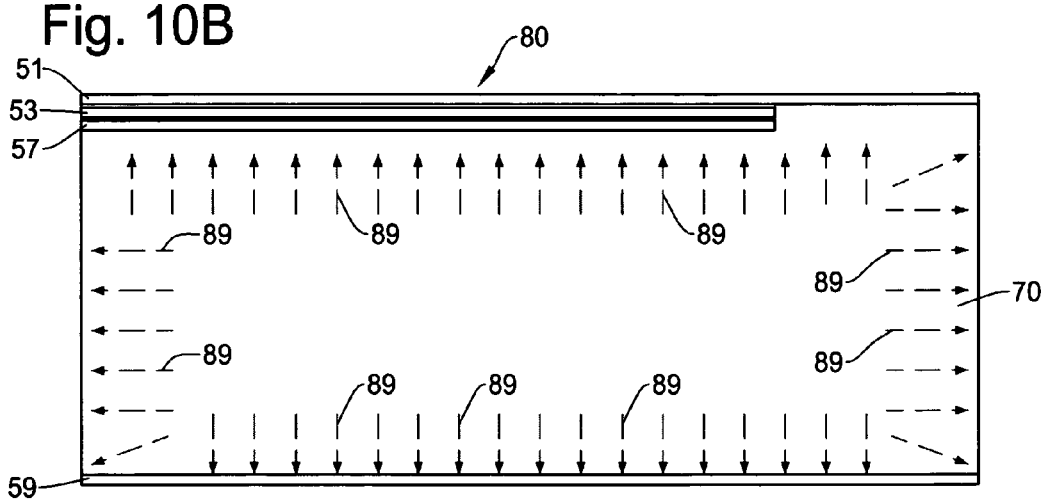

FIGS. 10A and 10B are simplified cross sectional views of the check valve 80 under the present invention. In FIGS. 10A and 10B, the bonded areas such as the folding seals 73, obstruction seals 83, air guide seals 81 are eliminated to simplify the view and ease of explanation. The upper packing film 51 and the lower packing film 59 form the shape of the air containers 70 when the separation seals 71 are formed on the air-packing device. The compressed air is introduced from the air input 90 (outermost peeling agent 91) to the common air duct 92 formed by the upper check valve film 53 and the lower check valve film 57.

As arrows 89 show, the air is introduced into the chamber (air container 70) through the air passages between the upper check valve film 53 and the lower check valve film 57. As the air fills the air container 70, the air begins to push up the check valve films 53 and 57. As shown in FIG. 10B, the upper check valve film 53 and the lower check valve film 57 are pushed up such that the lower valve film 57 attaches to the upper valve film 53, and the upper valve film 53 attaches to the uppermost film 51. Accordingly, the air passages in the check valve 80 are closed, thereby prohibiting the reverse flow of the air.

In the embodiment described above, the bonding (sealing) between the upper packing film 51 and the upper check valve film 53 is mostly identical to that between the upper check valve film 53 and the lower check valve film 57 such as shown in FIG. 3 and FIG. 6. In this example, the obstruction seal 85 and the air guide seal 81 are created between the upper check valve film 53 and the lower check valve film 57. The obstruction seal 85 and the air guide seal 81 are also created between the upper packing film 51 and the upper check valve film 53, although these seals are not essential to the check valve 80 of the present invention because the air will not flow between the upper packing film 51 and the upper check valve film 53.

Although not essential, the obstruction seal 85 and the air guide seal 81 between the upper packing film 51 and the upper check valve film 53 are created because of the same heat-sealing process applied to the air-packing device 101. Namely, when creating the obstruction seal 85 and the air guide seal 81 between the upper check valve film 53 and the lower check valve film 57, the heat-seals between the upper packing film 51 and the upper check valve film 53 by one heat-sealing applied to these three thermoplastic films.

However, it is also possible to create the shapes and locations of the heat-seals between the upper packing film 51 and the upper check valve film 53 differently from that between the upper check valve film and the lower check valve film 57. In such a case, the heat-sealing process for the air-packing device may become more complicated. For example, the air guide seals 81 may be created between the upper and lower check valve films 53 and 57 in advance. Then, the upper packing film 51 is overlapped on the check valve films 53 and 57 where the obstruction seals 83 and 85 are created for the three thermoplastic films. Finally, the three films are place on the lower packing film 59 where the separation seals 71 and the folding seals 73 are created for the four thermoplastic films.

Because of the configuration of the check valve 80 described above, the air-packing device 101 of the present invention achieves several advantages. One major advantage attained by the configuration of the check valve 80 is its ability to be formed in a small size. One of the reasons is that the separation seals 71 and the folding seals 73 can also function to create the air passages (air flow maze) for the check valve 80. As a result, it is possible to provide an air-packing device having many small air cells 72 so that it can replace air bubble packing materials used today which have a large number of air bubbles.

Another advantage of the air-packing device of the present invention is that the check valve 80 can be placed in a flexible manner at any desired locations of the air-package device. As described in the foregoing, the common air duct 92 is formed between the upper check valve film 53 and the lower check valve film 57. Thus, the common air duct 92 will not depend upon structure or location of other thermoplastic films such as the upper packing film 51 or the lower packing film 59.

Figure 11A:
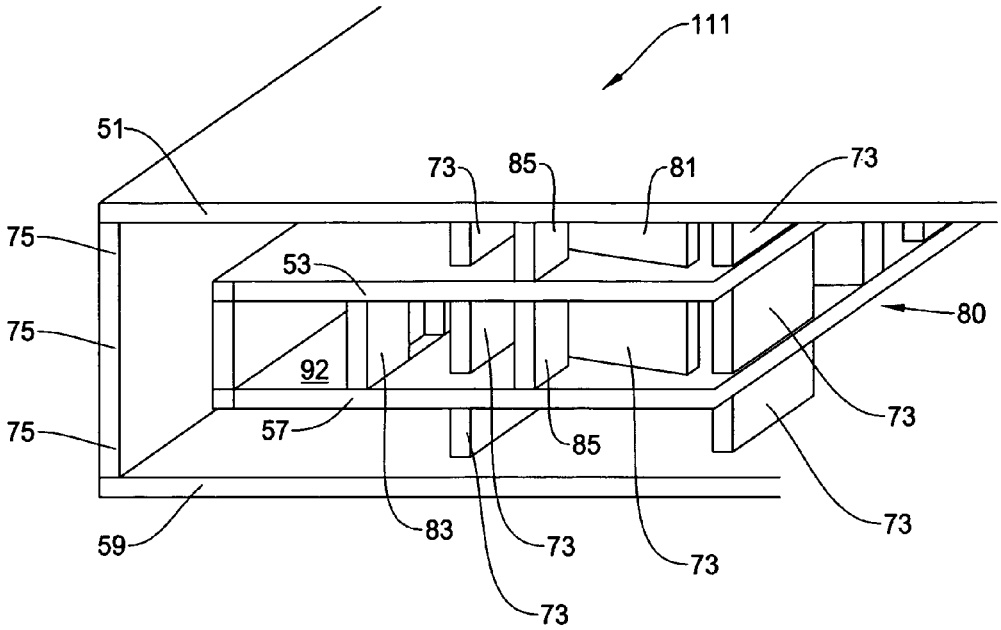
FIG. 11A is a perspective view showing an alternative of the present invention where the check valves are placed at an inner area of the air-packing device, and FIG. 11B a perspective plan view showing a further alternative of the present invention where the common duct formed by the check valve films are placed outside of the air-packing device.
Figure 11B:
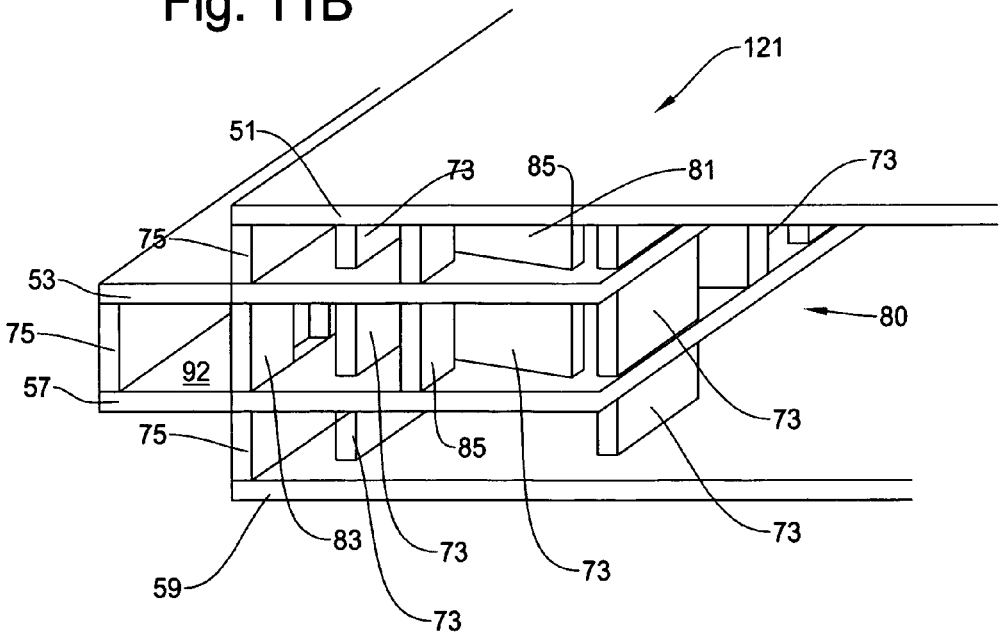
FIGS. 11C and 11D are perspective view showing further alternatives that correspond to FIGS. 11A and 11B where a single sheet of check valve film is folded to create the upper and lower check valve films.

FIGS. 11A and 11B are cross sectional perspective views of the air-packing device of the present invention where the location of the check valve 80 is shifted from that described in the foregoing example. FIG. 11A shows a structure of the air-packing device 111 where the check valves 80 (upper and lower check valve films 53 and 57) are placed at an inner area of the air-packing device 111 as opposed to the edge of the air-packing device 101 depicted in FIG. 6.

FIG. 11B shows a structure of the air-packing device 121 where a part of the check valve 80 (the common duct 92 formed by the check valve films 53 and 57) is placed outside of the upper packing film 51 and the lower packing film 59 of the air-packing device. This embodiment is able to reduce the inside area in the air-packing device 121 occupied by the check valves 80. The check valves 80 in FIGS. 11A and 11B function in the same manner as described above so that the air passages in the check valves 80 are open for the forward air flow and while they are closed by the inner air pressure when the air is filled in the air-packing device to prevent the reverse flow of the air.

Figure 11C:
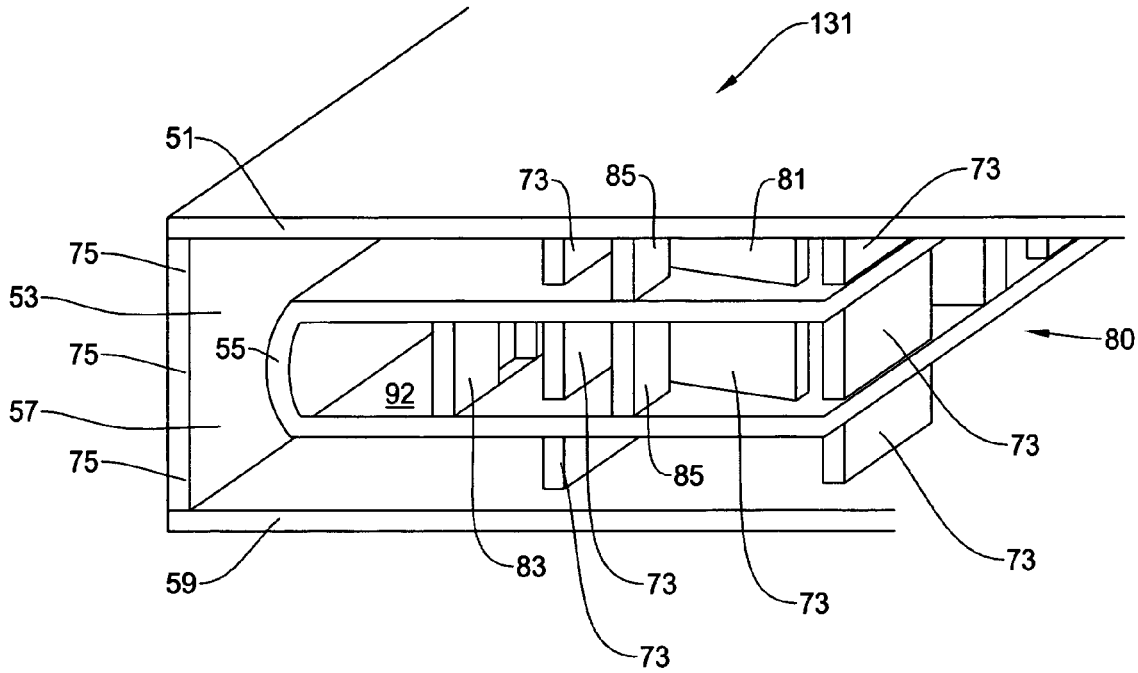
Figure 11D:
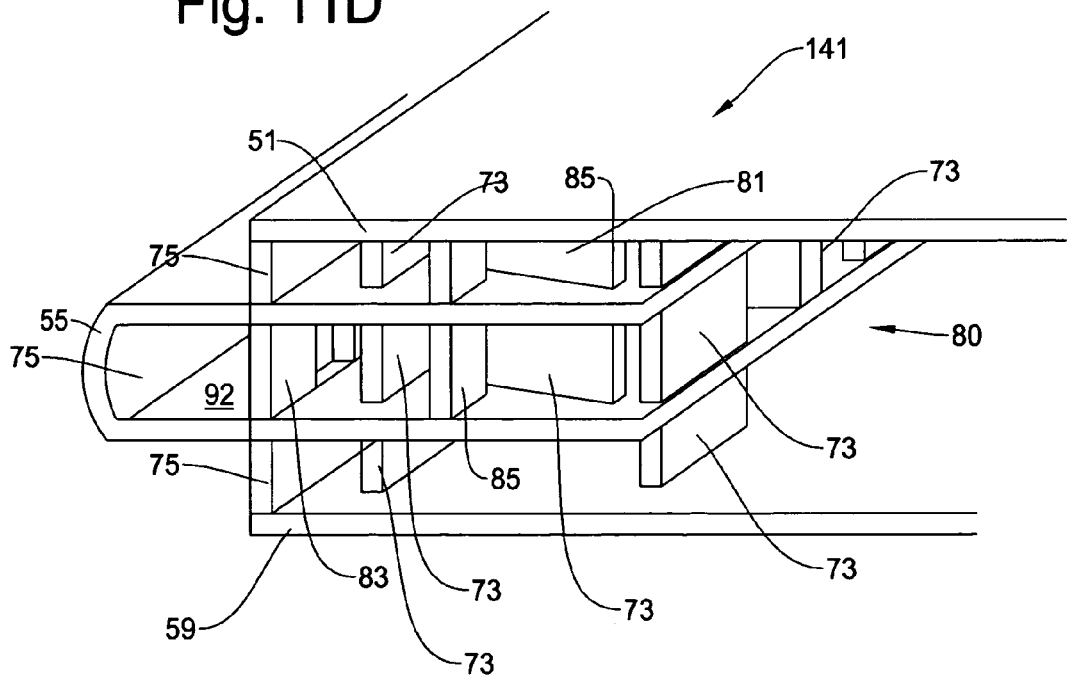

FIGS. 11C and 11D are cross sectional perspective view of the air-packing device of the present invention where the location of the check valves 80 is in the manner similar to FIGS. 11A and 11B, respectively. In the air-packing device 131 of FIG. 11C, the check valves 80 are configured by a single sheet of check valve film 55 which is folded to form the upper and lower check valve films 53 and 57. In the air-packing device 141 of FIG. 11D, the check valves 80 which are configured by a single sheet of check valve film 55 which is folded to form the upper and lower check valve films 53 and 57. FIG. 11C shows the condition where the check valves 80 (upper and lower check valve films 53 and 57) are placed at an inner area of the air-packing device 131. FIG. 11D shows the condition where a part of the check valve 80 (the common duct formed by the check valve films 53 and 57) is placed outside of the upper packing film 51 and the lower packing film 59 of the air-packing device 141.

Figure 12A:
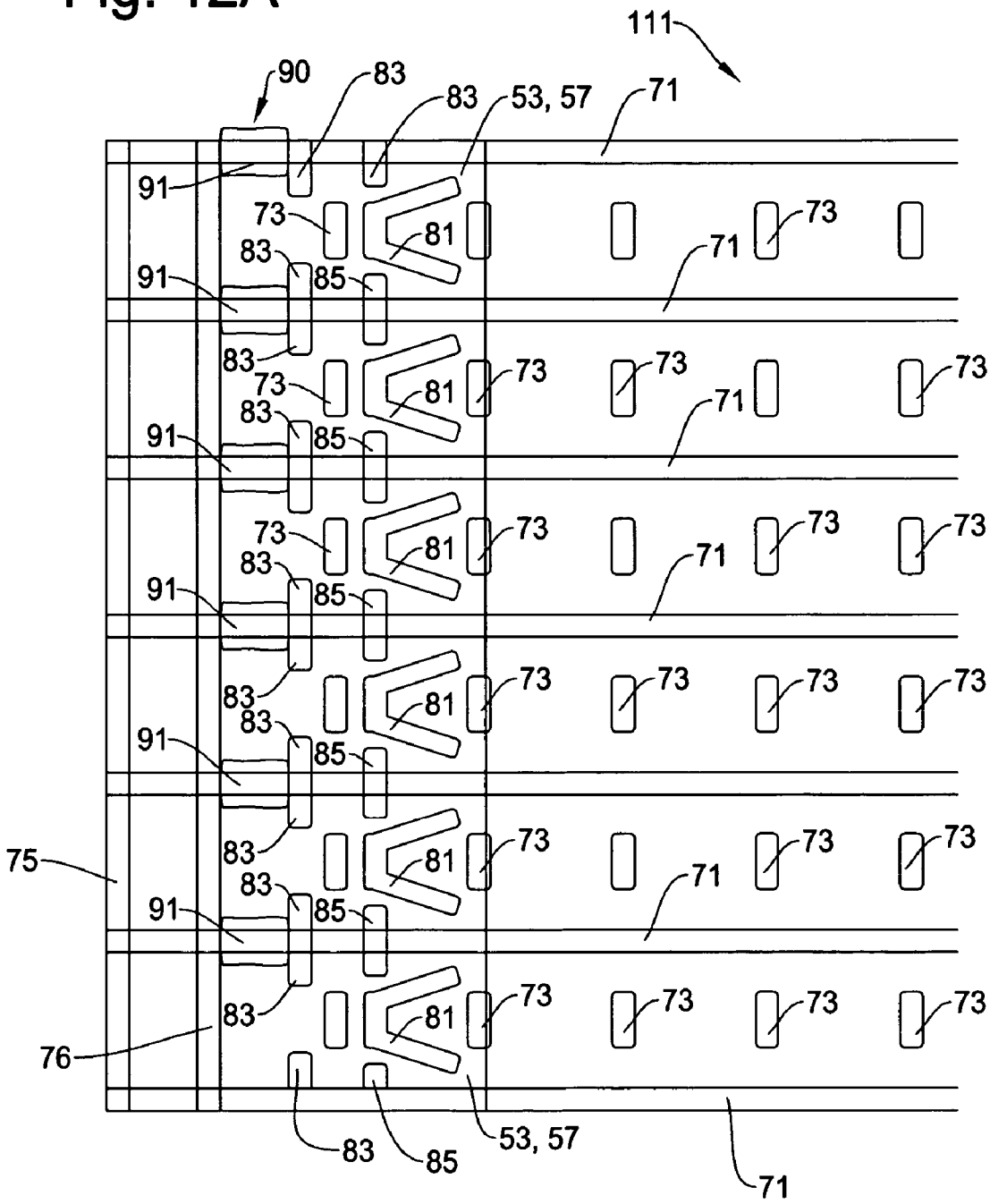
FIGS. 12A and 12B are schematic plan views showing the check valve and the air container of the air-packing device of the present invention that correspond to those shown in FIGS. 11A and 11B, respectively.
Figure 12B:
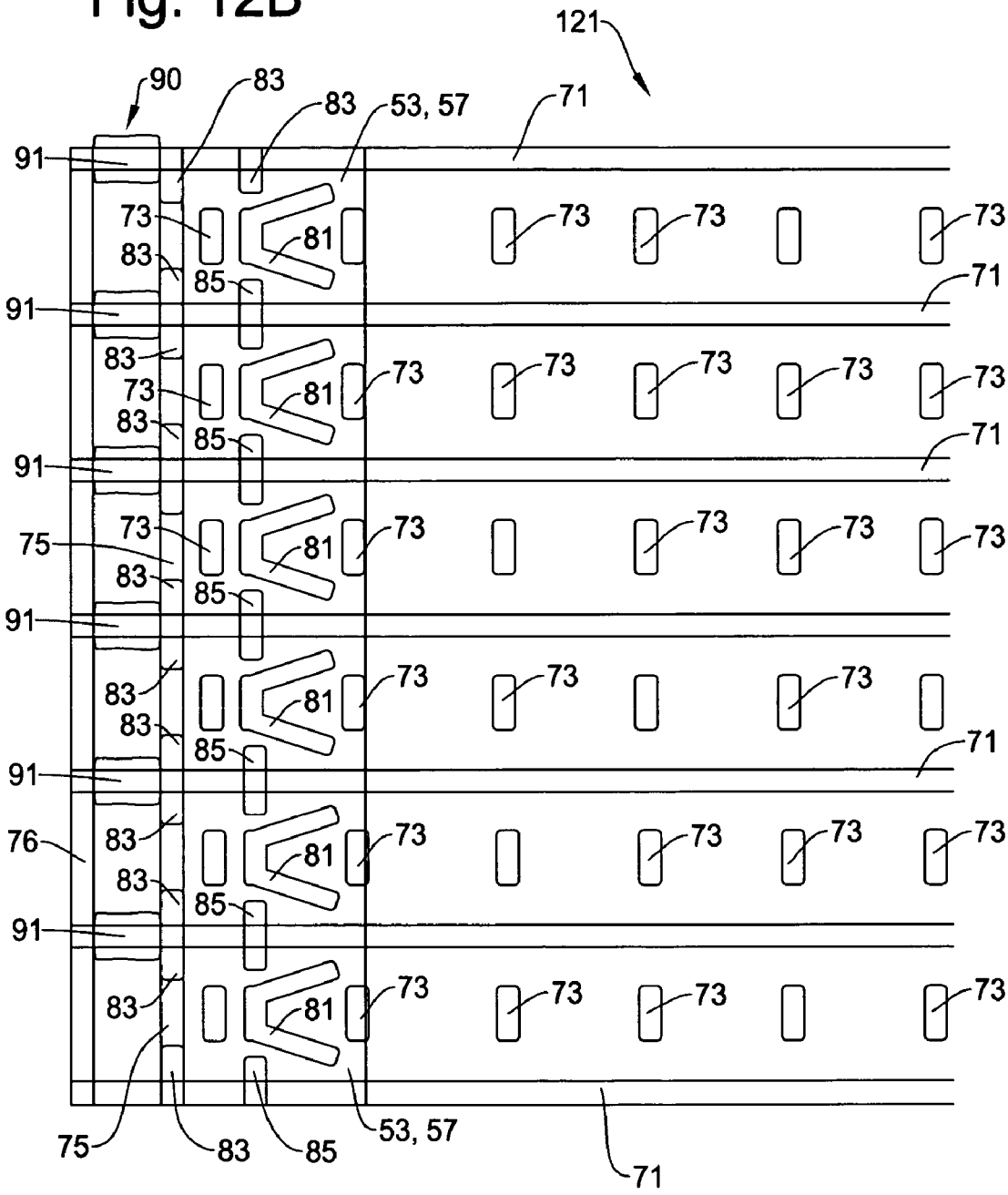

FIGS. 12A and 12B are plan views showing the check valves and the air containers that correspond to those shown in FIGS. 11A and 11B, respectively. In the embodiment shown in FIG. 12A, the check valves 80 formed by the films 53 and 57 are placed at an inner area of the air-packing device 111 rather than the edge of the air-packing device. In the embodiment shown in FIG. 12B, a part of the check valve 80 forming the common duct 92 is outside of the end of the air-packing device 121.

Figure 13:
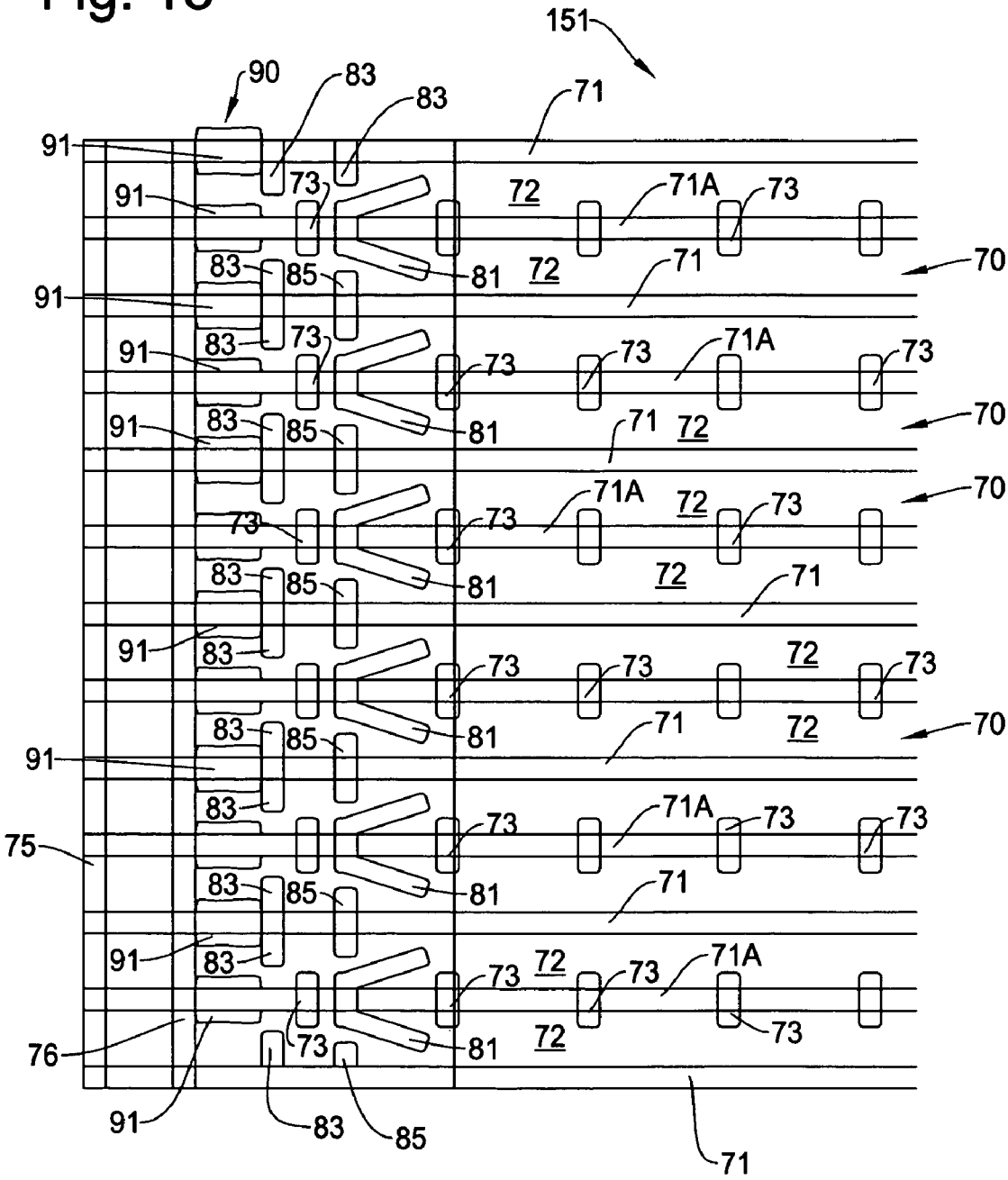
FIG. 13 is a schematic plan view showing the check valve and the air container in an alternative embodiment under the present invention where additional separation seals are provided at the middle of the air container in parallel to other separation seals.

The configuration of the check valve under the present invention allows flexible design of the air-packing device by enabling flexible placement of the seals. An example of a configuration of the air-packing device that takes advantage of the present invention is shown in the plan view of FIG. 13. The air-packing device 151 in FIG. 13 is similar to the one shown in FIG. 12A, except that additional separation 71A are provided in parallel with and between container seals 71. This in effect narrows the width of the air container 70, thereby making it possible to form each air cell 72 very small. Only a minor change of the check valve is necessary for this modification, thereby reducing time and cost associated with designing and changing of apparatus for manufacturing the air-packing device 151.

Figure 14:
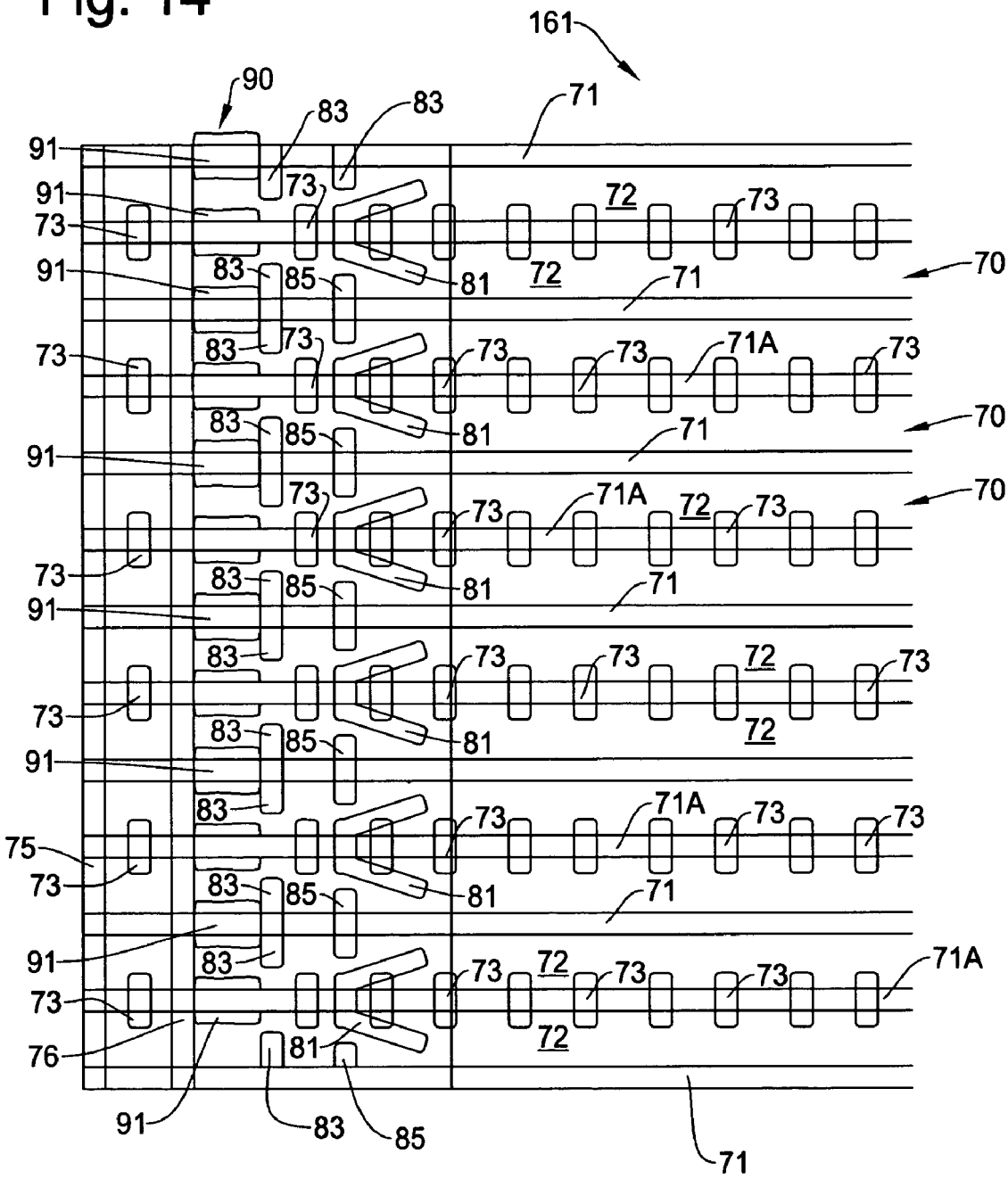
FIG. 14 is a plan view showing another embodiment of the air packing device having the check valve under the present invention similar to that shown in FIG. 12A except that many more separation seals are provided to create a large number of air cells.
Figure 15:
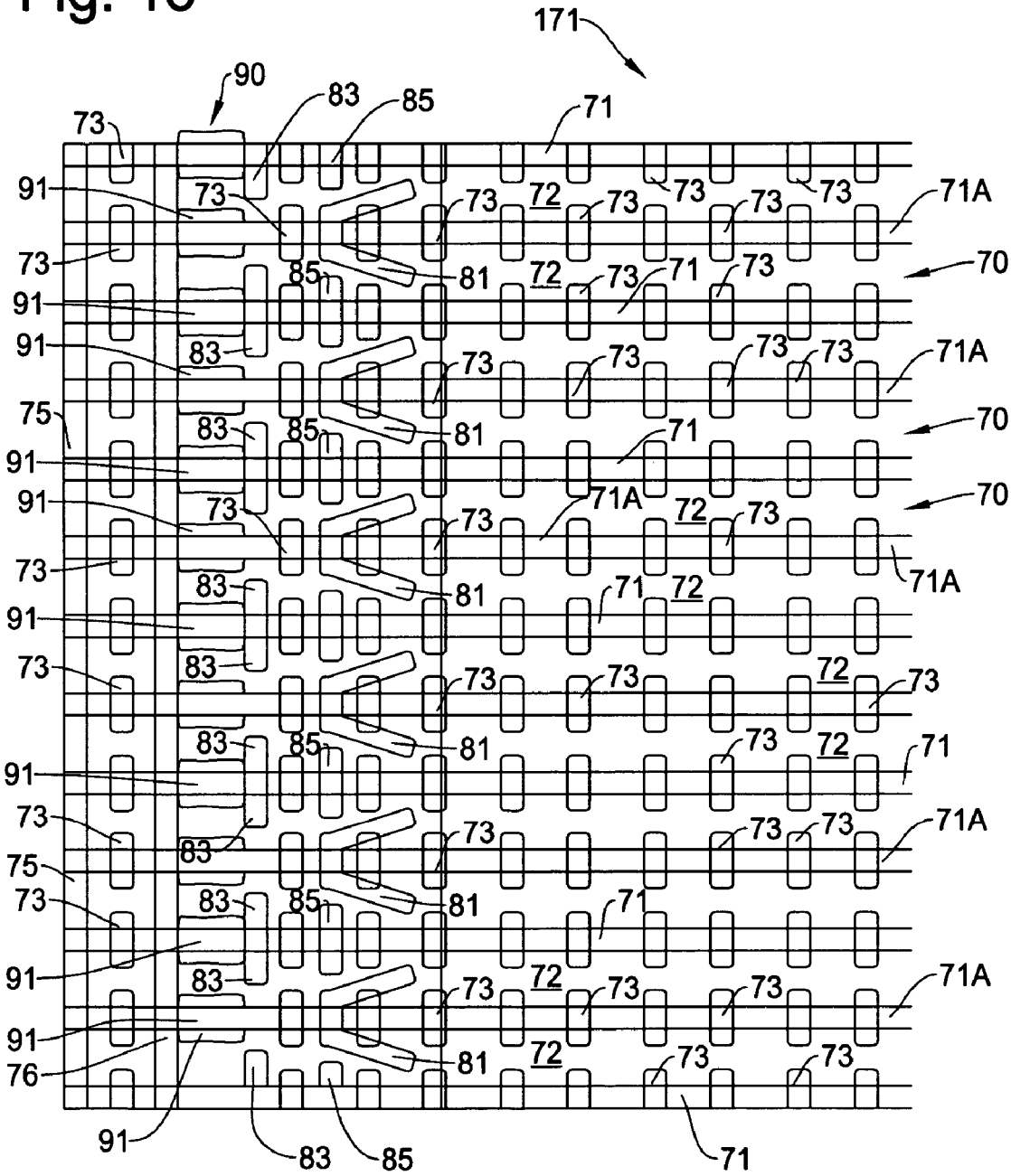
FIG. 15 is a plan view showing another embodiment of the air-packing device having the check valve under the present invention where additional separation seals such as shown in FIG. 13 are used and the folding seals are provided in a manner to traverse the separation seals.

In a similar manner, the check valve under the present invention allows variation of the air-packing device such that air-packing devices can accommodate various kinds of product to be protected. Some other embodiment example of the air-packing device incorporating the check valves under the present invention are shown in FIGS. 14 and 15. FIG. 14 is a plan view showing the air packing device 161 having the check valve under the present invention similar to the one shown in FIG. 12A except that more folding seals 73 are provided to create more air cells. The separation seals 73 can be placed within the check valve itself as shown in FIG. 14. Thus, freedom in designing the air packing device is improved, and thus, the conventional air bubble packing sheets can be replaced by the air-packing device 161 of the present invention.

FIG. 15 is a plan view showing still another example of the air-packing device having the check valve under the present invention. In the air-packing device 171, additional separation seals 71A such as shown in FIG. 13 are used and the folding seals 73 are provided not only at the middle of each containers 70 but also at the edge of the separation seals 71 in a manner to traverse the separation seals 71. Thus, a plurality of small air cells 72 are formed that are divided by four folding seals 73.

As has been described above, the structure of check valve for an air-packing device under the present invention is simple and allows reduction of the size of each check valve such that more freedom is attained in designing the air packing device. Moreover, the check valves under the present invention can be flexibly attached to any desired location of the air-packing device due to the common duct that is formed between the upper and lower check valve films independently from the packing films.

Although the invention is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. A structure of check valves for use in an air-packing device for packing a product, comprising:

a plurality of air containers each being made of upper and lower packing films by applying separation seals where a check valve is provided to each air container;

upper and lower check valve films for forming a plurality of check valves, the upper and lower check valve films being attached to one of the upper and lower packing films;

an air passage formed in each check valve by heat-seals between the upper and lower check valve films, the air passage including a narrow channel formed by the separation seal and one of the heat-seals between the upper and lower check valve films;

obstruction seals which provide resistance against the flow of the air in the check valves, and air guide seals which guide the forward flow of the air through said air passage created with the separation seals when the compressed air supplied to the air-packing device from an air source;

a common air duct formed between the upper and lower check valve films for providing the air from the air input commonly to the plurality of check valves;

wherein folding seals are formed at about the center of each air container to create the plurality of air cells in series for each air container, wherein heat-sealing between the upper and lower check valve films is prevented in a range where peeling agents of predetermined pattern are used between the upper and lower check valve films, thereby creating the common air duct, and an air input established by one of the peeling agents on the air-packing device for receiving the air from the air source.

2. A structure of check valves as defined in claim 1, wherein the upper and lower packing films are separate thermoplastic films, and wherein the upper and lower check valve films are separate thermoplastic films which are provided between the upper and lower packing films.

3. A structure of check valves as defined in claim 1, wherein the upper and lower packing films are separate thermoplastic films, and wherein the upper and lower check valve films are configured by a single sheet of thermoplastic film which is folded into two and is provided between the upper and lower packing films.

4. A structure of check valves as defined in claim 1, wherein the upper and lower check valve films are attached to one of the upper and lower packing films at any desired locations of the air-packing device.

5. A structure of check valves as defined in claim 1, wherein the air passage in the check valve is closed by air tightly contacting the upper check valve film and the lower check valve film by the air pressure within the air container when the air-packing device is filled with the compressed air to a sufficient degree.

6. A structure of check valves as defined in claim 1, wherein the air passage in the check valve is closed by air tightly contacting the upper check valve film, the lower check valve film, and one of the upper and lower packing films by the air pressure within the air container when the air-packing device is filled with the compressed air to a sufficient degree.

7. A structure of check valves as defined in claim 1, wherein the peeling agent between the upper and lower check valve films is located on a part of the separation seal, and wherein the air input is an opening between the upper check valve film and the lower check valve film created by a pattern of the peeling agent.

8. A structure of check valves as defined in claim 1, wherein the pattern of the peeling agent applied to the check valve films is a belt like shape extending on the separation seal of the air-packing device.

9. An air-packing device for packing a product therein, comprising:

a plurality of air containers each being made of upper and lower packing films by applying a pair of separation seals where a check valve is formed for each air container;

a plurality of air cells formed in a series manner in each container by partially bonding the upper packing film and the lower packing film by applying folding seals;

upper and lower check valve films for forming a plurality of check valves, the upper and lower check valve films being attached to one of the upper and lower packing films;

an air passage formed in each check valve by heat-seals between the upper and lower check valve films, the air passage including a narrow channel formed by the separation seal and one of the heat-seals between the upper and lower check valve films;

obstruction seals which provide resistance against the flow of the air in the check valves, and air guide seals which guide the forward flow of the air through said air passage created with the separation seals when the compressed air supplied to the air-packing device from an air source;

a common air duct formed between the upper and lower check valve films for providing the air from the air input commonly to the plurality of check valves;

wherein folding seals are formed at side edges of each air container in a manner to traverse the separation seals to create the plurality of air cells in series for each air container;

wherein heat-sealing between the upper and lower check valve films is prevented in a range where peeling agents of predetermined pattern are used between the upper and lower check valve films, thereby creating the common air duct, and an air input established by one of the peeling agents on the air-packing device for receiving the air from the air source.

10. An air-packing device as defined in claim 9, wherein the upper and lower packing films are separate thermoplastic films, and where the upper and lower check valve films are separate thermoplastic films which are provided between the upper and lower packing films.

11. An air-packing device as defined in claim 9, wherein the upper and lower packing films are separate thermoplastic films, and where the upper and lower check valve films are configured by a single sheet of thermoplastic film which is folded into two and is provided between the upper and lower packing films.

12. An air-packing device as defined in claim 9, wherein the upper and lower check valve films are attached to one of the upper and lower packing films at any desired locations of the air-packing device.

13. An air-packing device as defined in claim 9, wherein an additional separation seal is formed at about the center of each air container in parallel with the pair of separation seals to increase an overall number of air cells in each air container.

14. An air-packing device as defined in claim 9, wherein an additional separation seal is formed at about the center of each air container in parallel with the pair of separation seals to increase an overall number of air cells in each air container.

15. An air-packing device as defined in claim 9, wherein the air passage in the check valve is closed by air tightly contacting the upper check valve film and the lower check valve film by the air pressure within the air container when the air-packing device is filled with the compressed air to a sufficient degree.

16. An air-packing device as defined in claim 9, wherein the air passage in the check valve is closed by air tightly contacting the upper check valve film, the lower check valve film, and one of the upper and lower packing films by the air pressure within the air container when the air-packing device is filled with the compressed air to a sufficient degree.

17. An air-packing device as defined in claim 9, wherein the peeling agent between the upper and lower check valve films is located on a part of the separation seal, and wherein the air input is an opening between the upper check valve film and the lower check valve film created by a pattern of the peeling agent.

18. An air-packing device as defined in claim 9, wherein the pattern of the peeling agent applied to the check valve films is a belt like shape extending on the separation seal of the air-packing device.

* * * * *